United States Patent [19]

Welch

[11] 4,119,833

[45] Oct. 10, 1978

[54] ELECTRIC WATER HEATER

[76] Inventor: Stephen A. Welch, 7624 Finevale, Downey, Calif. 90240

[21] Appl. No.: 776,843

[22] Filed: Mar. 14, 1977

Related U.S. Application Data

[63] Continuation of Ser. No. 627,202, Oct. 30, 1975, abandoned.

[51] Int. Cl.[2] ..... H05B 3/60; F22B 1/30; H01C 10/02

[52] U.S. Cl. ..... 219/285; 219/289; 219/291; 219/293; 338/83

[58] Field of Search ..... 219/284–295, 219/271–276; 338/80–86

[56] References Cited

U.S. PATENT DOCUMENTS

| | | | |
|---|---|---|---|
| 1,171,929 | 2/1916 | Cubitt | 219/286 |
| 2,403,334 | 7/1946 | Blanchard | 219/285 |
| 2,572,337 | 10/1951 | Harris | 219/285 |
| 2,748,253 | 5/1956 | Bremer | 219/291 X |
| 3,299,252 | 1/1967 | Meek | 219/293 |
| 3,398,261 | 8/1968 | Mays | 219/293 X |
| 3,513,291 | 5/1970 | Mamoulides et al. | 219/285 |

FOREIGN PATENT DOCUMENTS

| | | | |
|---|---|---|---|
| 1,033,336 | 4/1953 | France | 219/291 |

*Primary Examiner*—A. Bartis

[57] ABSTRACT

An electric water heater that includes a metallic housing having a water inlet and outlet, and a non-electrically conducting liner that is impervious to the action of water. First and second carbon electrodes, each in the form of a plate wedge-shaped in cross-section and having an obliquely disposed flat surface, are arranged within the liner with their respective obliques flat surfaces in parallel spaced relation to define a water passage therebetween. Manually operable means permit the second electrode to be moved relative to the first electrode to vary the width of a water passage defined between the electrodes. The housing supports first and second electric terminals that are insulated from one another, but are in electrical communication with the first and second electrodes. The degree to which water will be heated is dependent on the velocity at which the water flows through the passage between the first and second electrodes, and this velocity being determined by varying the width of the passage between the electrodes by use of the previously mentioned manually operated means.

8 Claims, 4 Drawing Figures

FIG. 1
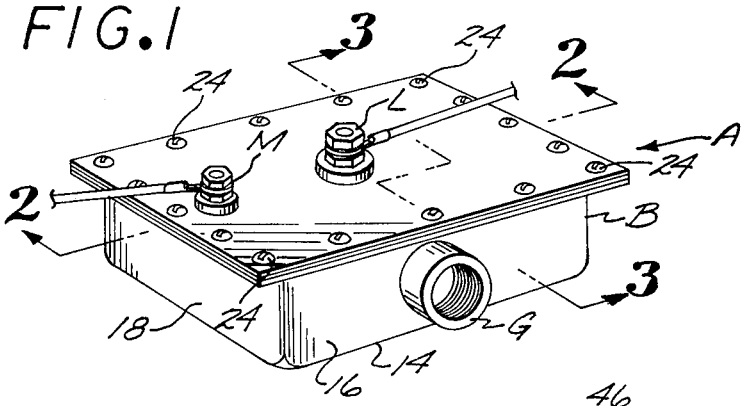
FIG. 2
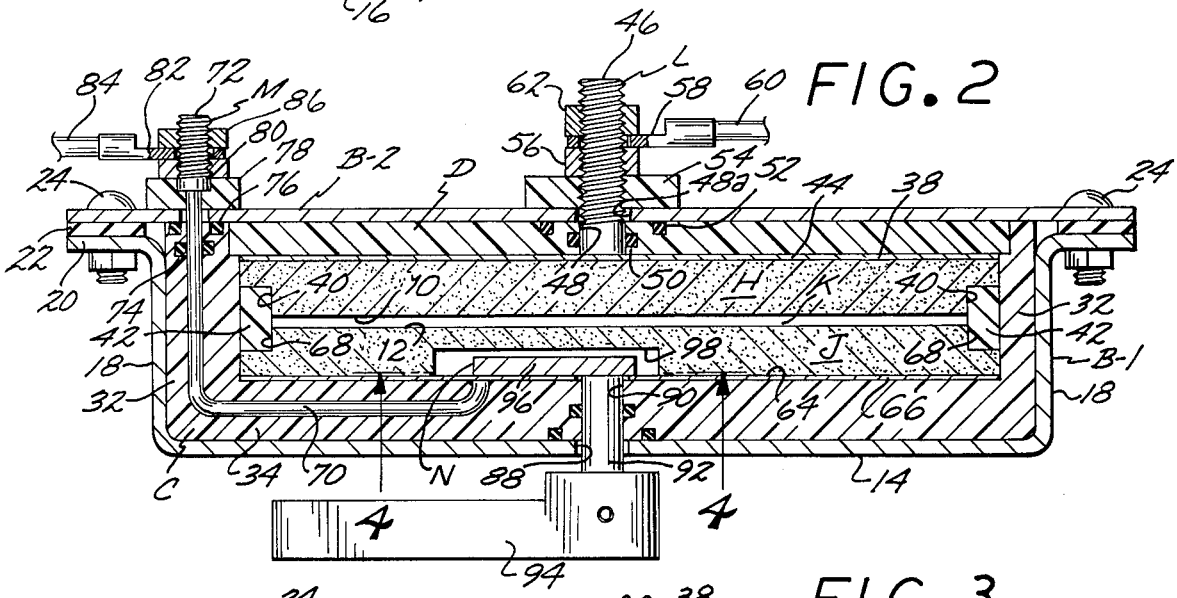
FIG. 3
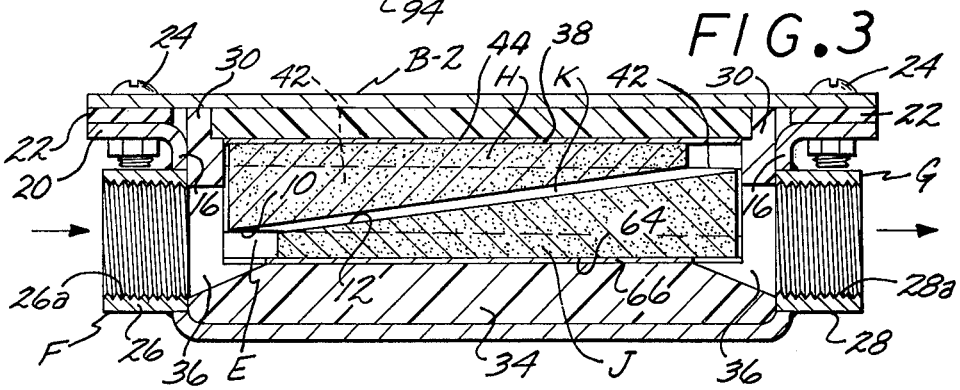
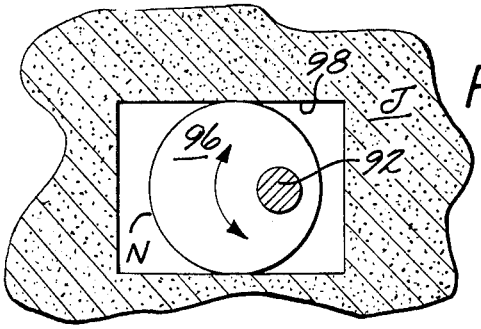
FIG. 4

ELECTRIC WATER HEATER

This is a continuation of Application Ser. No. 627,202, filed Oct. 30, 1975 now abandoned.

BACKGROUND OF THE INVENTION

1. Field of the Invention

Electric water heater of the fluid circuit type.

2. Description of the Prior Art

The majority of present day water heaters, irrespective of whether they are gas fired or electrically operated, include a reservoir in which the heated water is stored. This type of heater has the operational disadvantage that it occupies excessive space, and has a limit on the amount of heated water that can be continuously withdrawn therefrom.

A major object of the present invention is to supply a water heater in which the water is heated to a desired degree as the water flows therethrough, and a heater capable of being operated continuously to supply heated water in any desired amount.

Another object of the invention is to furnish a water heater that has a simple mechanical structure, can be fabricated from standard commercially available materials, is simple and easy to use, and requires a minimum of maintenance attention.

A further object of the invention is to supply a water heater that can be adjusted to control the velocity of flow of water therethrough, which velocity together with the mineral content of the water determine the degree to which the water will be heated in flowing through the heater.

SUMMARY OF THE INVENTION

An electric water heater that includes a metallic housing having a water inlet and outlet, and a non-electrically conducting liner that is impervious to the action of water. The liner defines a confined space that is in communication with the inlet and outlet, and in which confined space first and second carbon electrodes are disposed. The electrodes are each in the form of a plate wedge-shaped in cross section and having an obliquely disposed flat surface. The electrodes are arranged within the liner with their respective oblique flat surfaces in parallel spaced relation to define a water passage therebetween. The invention is illustrated as including a cam operated device that may be manually actuated to move the second electrode relative to the first electrode to vary the width of the water passage defined therebetween. The housing has first and second electric terminals mounted thereon in insulated relationship with one another, and the first and second terminals being in electrical communication with the first and second electrodes. The degree to which water will be heated in flowing through the passage is dependent not only upon the velocity of the water flowing through the passage but the mineral content of the water. The higher the mineral content of the water the more electrically conductive it will be, and as a result when the water has substantial electrical conductivity the first and second electrodes must be spaced further apart to obtain a desired heating of the water. Once the spacing between the first and second electrodes has been established for a particular type of water, and the temperature to which the water is to be heated has been determined, the electrodes after being spaced for these conditions need not be further adjusted. The electric heater may be operated continuously to heat water as it flows through the passage between the first and second electrodes and as a result heated water in any desired amount may be provided by use of the invention.

BRIEF DESCRIPTION OF THE DRAWING

FIG. 1 is a perspective view of the water heater;

FIG. 2 is a transverse cross-sectional view of the water heater taken on the line 2—2 of FIG. 1;

FIG. 3 is a second cross-sectional view of the water heater taken on the line 3—3 of FIG. 1; and FIG. 4 is a fragmentary bottom plan view of a portion of the water heater taken on the line 4—4 of FIG. 2.

DESCRIPTION OF THE PREFERRED EMBODIMENT

The electric water heater A, as may be seen in FIGS. 1, 2 and 3, includes a metallic housing B, which housing further includes a rectangular enclosure B-1 and a cover plate B-2 that is removably mounted thereon. The housing B serves to contain a cup shape liner C that, in conjunction with a plate D, forms a confined space E. The liner C and plate D are formed from a non-electrical conducting material such as a polymerized resin. The heater A includes a water inlet F and water outlet G, both of which are in communication with the confined space E. The first and second electrodes H and J, both of which may comprise a plate of wedge-shaped cross sectional configuration, have adjacently disposed respective flat oblique faces 10 and 12 in spaced parallel relationship. The electrodes are situated within the confined space E and serve to define a passage K therebetween through which water may flow from the inlet F to the outlet G. First and second electric terminals L and M are mounted in electrically spaced relationship on the cover plate B-2, as may be seen in FIGS. 1 and 2, with the first terminal L being connected to the first electrode H and the second terminal M to the second electrode J. Manually operable cam means N, best seen in FIGS. 2 and 4, permit the second electrode J to be moved relative to the first electrode H to vary the width of the passage K therebetween through which water flows.

The housing B as may be seen in FIGS. 1, 2 and 3 includes a bottom 14, a pair of end walls 16, and a pair of side walls 18, with the upper extremities of the side walls and end walls developing into a continuous outwardly extending flange 20. The flange has a sealing gasket 22 mounted thereon on which the cover plate B-2 rests. Screw and nut assembly 24 serve to removably hold the cover plate B-2 on the enclosure B-1 as shown in FIG. 2. The water inlet F is defined by a first tubular boss 26 as shown in FIG. 3, which boss has threads **26*a* formed on the interior thereof to permit engagement with the threaded end of a water supply pipe (not shown). The water outlet G is defined by a second tubular boss 28 as shown in FIG. 3 that has threads 28*a*** formed on the interior thereof to permit the water flow outlet to be connected to a heated water supply pipe (not shown).

The cup shape liner C includes a pair of end pieces 30, a pair of side pieces 32, and a bottom 34, with the enclosure being of such size and dimension as to be snugly insertable within the enclosure B-1 as shown in FIGS. 2 and 3. The liner C also includes a bottom 34, as well as a pair of openings 36 formed in the end pieces 30 as shown in FIG. 3, which openings are in communication with the confined space E, the water inlet F and the water outlet G.

The first electrode H includes a flat upper surface 38, and a pair of recesses 40 that extend along the sides thereof parallel to the water inlet and outlet F and G. The recesses 40 engage the upper portion of a pair of elongate members 42 of rectangular transverse cross section that are formed from a polymerized resin. The flat upper surface 38 is in abutting electrical communication with a first metallic sheet 44, which sheet has a threaded rod 46 extending upwardly therefrom, and the rod passing through an opening 48 formed in the plate D as well as an opening 48*a* formed in the cover plate B-2. First and second resilient O-rings 50 and 52 are mounted in recesses formed in the plate D and are in sealing contact with the lower portion of the rod 46 and the undersurface of the cover plate B-2. An electrically insulating washer 54 is mounted on threaded rod 46 and is held in abutting contact with cover plate B-2 by a lock nut 56. A terminal 58 of a first electrical conductor 60 is held on the threaded rod 46 by a nut 62.

The second electrode J has a flat lower surface 64 as may be seen in FIG. 2 that rests on the bottom 34. The second electrode J has a pair of recesses 68 therein that engage the lower portion of the members 42 as may be seen in FIG. 2. The second electrically conducting sheet 66 has an electrical conductor 70 connected to the lower surface thereof with this conductor extending through the bottom 34 and one of the side walls 32 as shown in FIG. 2 to project upwardly above the cover plate B-2 and develop into a threaded rod 72 that defines the second electrical terminal M. The side piece 32 through which the conductor 70 extends has recesses formed therein in which first and second O-rings 74 and 76 are disposed to seal with the conductor 32 and the cover plate B-2. Conductor 70 above cover plate B-2 has an electrically insulating washer 78 mounted thereon, which washer is held in abutting contact with the upper surface of the cover plate B-2 by a locking nut 80, and the threaded rod 72 being engaged by a second terminal 82 that is connected to a second electrical conductor 84 as shown in FIGS. 1 and 2. The terminal 82 is held on the threaded rod 72 by a nut 86.

Bottom 14 as may be seen in FIG. 2 has an opening 88 formed therein that is axially aligned with a bore 90 formed in the bottom 34, and the opening and bore having a rod 92 extending upwardly therethrough, which rod may be rotated by a handle 94 serving as a handhold. The rod 92 on the upper end thereof is rigidly secured in an off-centered position to a circular plate 96 the surface of which serves the cam N and is rotatably disposed in a rectangular recess 98 that extends upwardly from the flat lower surface 64 of the second electrode J. The members 42 are of such height that when the heater is assembled as shown in FIG. 2, the second electrode J is held in abutting electrical contact with the second electrically conducting sheet 66. By rotating the handle 94 the cam 96 is rotated in the space 58, and the second electrode J is moved relative to the first electrode H to vary the spacing between the tapered surfaces 10 and 12, and the width of the water passage K. By varying the width of the passage K the resistance to flow of electricity between the first and second electrodes H and J may be varied, as well as the rate at which water flows through the passage K, with these two factors cooperating to determine the temperature at which water discharges through the outlet G.

The use and operation of the invention has been explained previously in detail, and need not be repeated.

I claim:

1. An electrically operated water heater that includes:

a. a housing having a water inlet and water outlet;

b. a liner of a non-electrically conducting material disposed within said housing, said liner having first and second openings therein that are axially aligned with said water inlet and water outlet, said liner defining a confined space within the interior thereof that is in communication with said first and second openings and said water inlet and outlet;

c. first and second electric terminals mounted on said housing and electrically insulated therefrom, said terminals being connected to a source of electric power;

d. first and second electrically conducting sheets disposed in said confined space in space parallel relationship and in abutting contact with said liner, said first and second sheets disposed between said first and second openings;

e. first and second electrode plates, each wedge-shaped in cross section and having an obliquely disposed flat surface, arranged in said confined space with the respective obliquely disposed disposed flat surfaces thereof disposed in opposed parallel spaced relation to define a water passage therebetween, said first and second electrode plates being situated in and substantially filling said confined space with each in abutting electrical contact with a respective one of said sheets, and said first and second electrode plates having opposed pairs of aligned elongated recesses formed therein; said second electrode plate being slidable on the sheet in abutting contact therewith relative to said first electrode whereby the spacing between said opposed obliquely disposed flat surfaces may be varied;

f. an elongate electrically insulative guide member engaging each pair of aligned recesses for guiding the movement of said second electrode plate and maintaining said first and second electrode plates in abutting contact with said first and second electrically conducting sheets, said first terminal being electrically connected to said first electrically conducting sheet and said second terminal being electrically connected to said second electrically conducting sheet; and h. means operable from the exterior of the housing for manually sliding the electrode plate on said second electrically conducting sheet in abutting contact therewith to vary the width of said passage and the rate at which water discharges therethrough, with the temperature of the discharging water being dependent on said rate and the resistance said water offers to the flow of electric current between said first and second electrode plates.

2. An electrically operated water heater as defined in claim 1 in which said housing includes:

i. a rectangular cup shaped enclosure that has an outwardly extending flange;

j. a sealing gasket mounted on said flange;

k. a cover plate that rests on said gasket; and l. means for removably securing said gasket and cover plate to said enclosure.

3. An electrically operated water heater as defined in claim 2 in which said liner is formed from a polymerized resin and includes:

m.. a rectangular cup that fits snuggly in said enclosure; and n. a plate that sealingly engages an open end of said cup, and said plate and cup cooperating to define said confined space.

4. An electrically operated water heater as defined in claim 2 in which said water inlet and water outlet are defined by first and second internally threaded bosses that project outwardly from said enclosure.

5. An electrically operated water heater as defined in claim 4 in which said first and second internally threaded bosses are oppositely located and with said first and second electrode plates situated therebetween.

6. An electrically operated water heater that includes;

a. a housing having a water inlet and water outlet;

b. a liner of a non-electrically conducting material disposed within said housing, said liner having first and second openings therein that are axially aligned with said water inlet and water outlet, said liner defining a confined space within the interior thereof that is in communication with said first and second openings and said water inlet and outlet;

c. first and second electric terminals mounted on said housing and electrically insulated therefrom;

d. first and second electrically conducting sheets electrically connected to respective terminals, said sheets being disposed in said confined space in spaced parallel relationship and in abutting contact with said liner, said first and second sheets being disposed between said first and second openings;

e. first and second electrode plates, each wedge-shaped in cross section and having an obliquely disposed flat surface, arranged in said confined space in abutting electrical contact with a respective one of said sheets and with the respective obliquely disposed flat surfaces thereof disposed in opposed parallel spaced relation to define a water passage therebetween, at least one of said electrode plates being movable on the sheet which it abuts relative to the other electrode plate whereby said obliquely disposed flat surfaces are movable relatively toward and away from each other to vary the spacing therebetween;

f. linearly extending guide means between said electrode plates and said liner for guiding movement of said plates parallel to each other;

g. means for manually moving one of said electrode plates parallel to the other to vary the width of said passage, with the temperature of the discharging water being dependent on said width and the resistance said water offers to the flow of electric current between said first and second electrode plates.

7. An electrically operated water heater as in claim 6 wherein said electrode plates are each composed of an integrated block of carbon and each said conducting sheet is of non-ferrous metal, each electrode plate and the respective conducting sheet having surfaces in sliding engagement with each other.

8. An electrically operated water heater as in claim 6 wherein said means for manually moving one of said plates includes a drive mechanism for moving said one of said electrode plates relative to the other comprising a hand hold on the exterior of the housing, a shaft on the hand hold extending into the housing and a drive connection from the shaft to said one electrode plate acting to drive said one electrode plate in a direction parallel to the other electrode plate whereby to vary the space between said surfaces, said one electrode plate being movable relative to its conducting plate.

* * * * *